United States Patent [19]

Takemura

[11] Patent Number: 4,933,719

[45] Date of Patent: Jun. 12, 1990

[54] IMAGE FORMING APPARATUS

[75] Inventor: Yoshinobu Takemura, Nara, Japan

[73] Assignee: Mita Industrial Co., Ltd., Osaka, Japan

[21] Appl. No.: 356,112

[22] Filed: May 24, 1989

[30] Foreign Application Priority Data

May 31, 1988 [JP] Japan ..... 63-73108[U]

[51] Int. Cl.[5] ..... G03G 21/00

[52] U.S. Cl. ..... 355/204; 355/313

[58] Field of Search ..... 355/204, 209, 313, 314

[56] References Cited

U.S. PATENT DOCUMENTS 4,453,821 6/1984 Smith ..... 355/313

4,494,861 1/1985 Tachika et al. ..... 355/313 X

*Primary Examiner*—A. T. Grimley

*Assistant Examiner*—Sandra L. Hoffman

*Attorney, Agent, or Firm*—Beveridge, DeGrandi & Weilacher

[57] ABSTRACT

In an image forming apparatus, when rewriting a program of a program memory, the operator can easily set desired image forming functions to the program memory on the basis of a standard state by an initializing operation when many functions are rewritten or when functions similar to the standard state are to be used.

1 Claim, 5 Drawing Sheets

(a)

(b)

(a)

(b)

IMAGE FORMING APPARATUS

BACKGROUND OF THE INVENTION

1. Field of the Invention

The present invention relates to an image forming apparatus having such a "programming function" than an operator who has previously set suitable kinds of image forming functions such as both side copying, partition copying, cover sheet copying, manuscript size setting, copy density setting, will at the time of copying be able to call up the above suitably set image forming functions and easily copy according to these functions.

2. Description of the Related Art

Hitherto when the operator uses the copying machine having a programming function and intends to rewrite the contents of the image forming functions, the operator first calls up the contents previously memorized in a memory device by a program output key, thereby to place the copying machine in a "program mode". Then the operator rewrites (changes) the called contents one by one by operating various kinds of keys for setting various kinds of image forming functions, on a console of the copying machine.

However for such conventional rewriting wherein the operator rewrites the previously set contents one by one, requires much labor when most of the new contents are standard for the copying machine or when there are many data to be rewritten. Summary of the invention The present invention intends to realize image forming apparatus wherein the operator first programs the image forming apparatus to a standard state (hereinafter referred as "initializing"), and then suitably rewrites or reprograms the apparatus.

Meanwhile a conventional copying machine is known wherein the contents of the functions are initialized by the operator's operating of an "all clear key". But in the conventional copying machine, the above-mentioned programming mode is canceled by the operation of the all clear key. Therefore the operator cannot rewrite the contents of the functions by utilizing the initialized state (standard state).

An image forming apparatus of the present invention comprises:

function set means for setting various kinds of image forming functions, first memory means for memorizing the various kinds of image forming functions set by the function set means, function displaying means for displaying the various kinds of image forming functions memorized in the first memory means, second memory means for memorizing preset various kinds of image forming functions, program output means for making the image forming apparatus at program mode and for setting said various kinds of image forming functions memorized in the second memory means to the first memory means, program input means for setting the various kinds of image forming functions in the first memory means to the second memory means under the program mode, a print key for starting image forming of the image forming apparatus, initializing means for initializing the contents of the first memory means under the program mode, and primary part means of the image forming apparatus for copying on the basis of the various kinds of image forming functions set in the first memory means by a signal from the print key.

Other and further objects, features and advantages of the invention will appear more fully from the following description.

DESCRIPTION OF THE PREFERRED EMBODIMENTS

Figure 1:
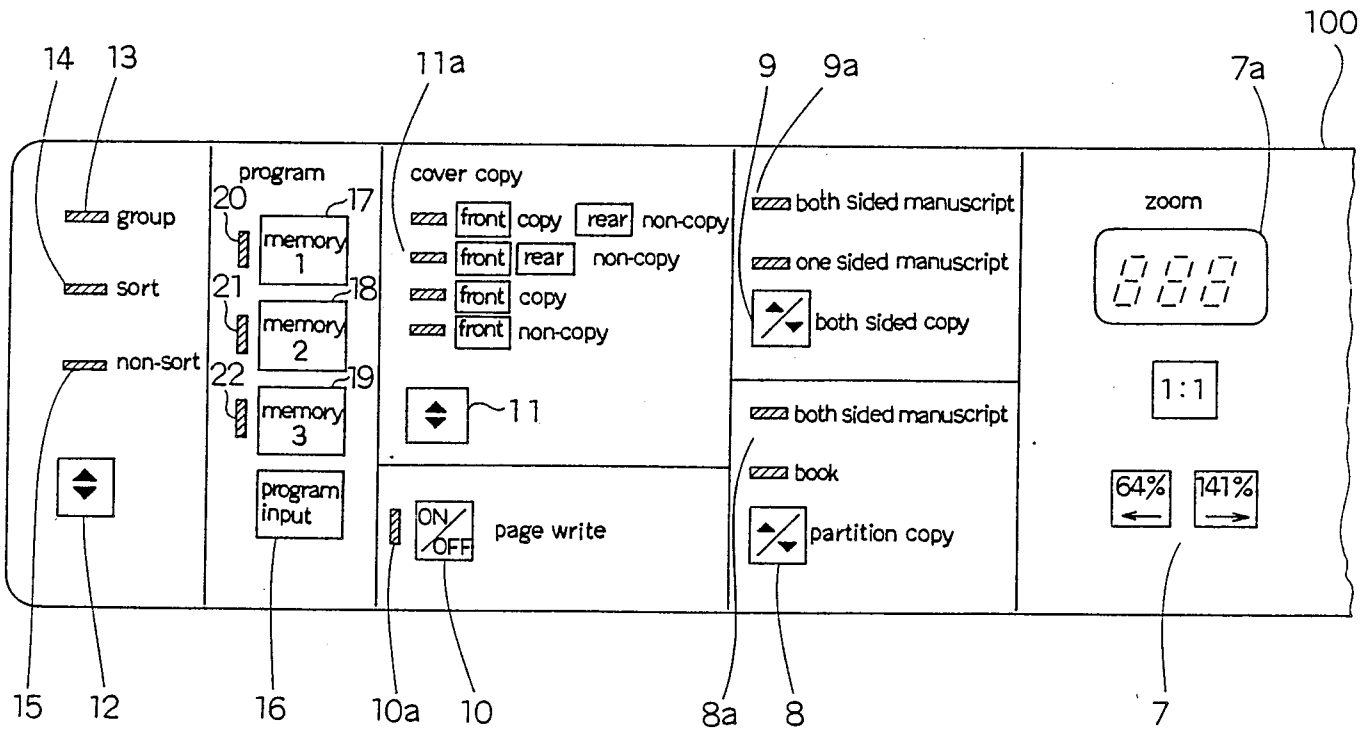
FIGS. 1 (*a*), (*b*) show a plane view of a console of an embodiment of the present invention.
Figure 1:
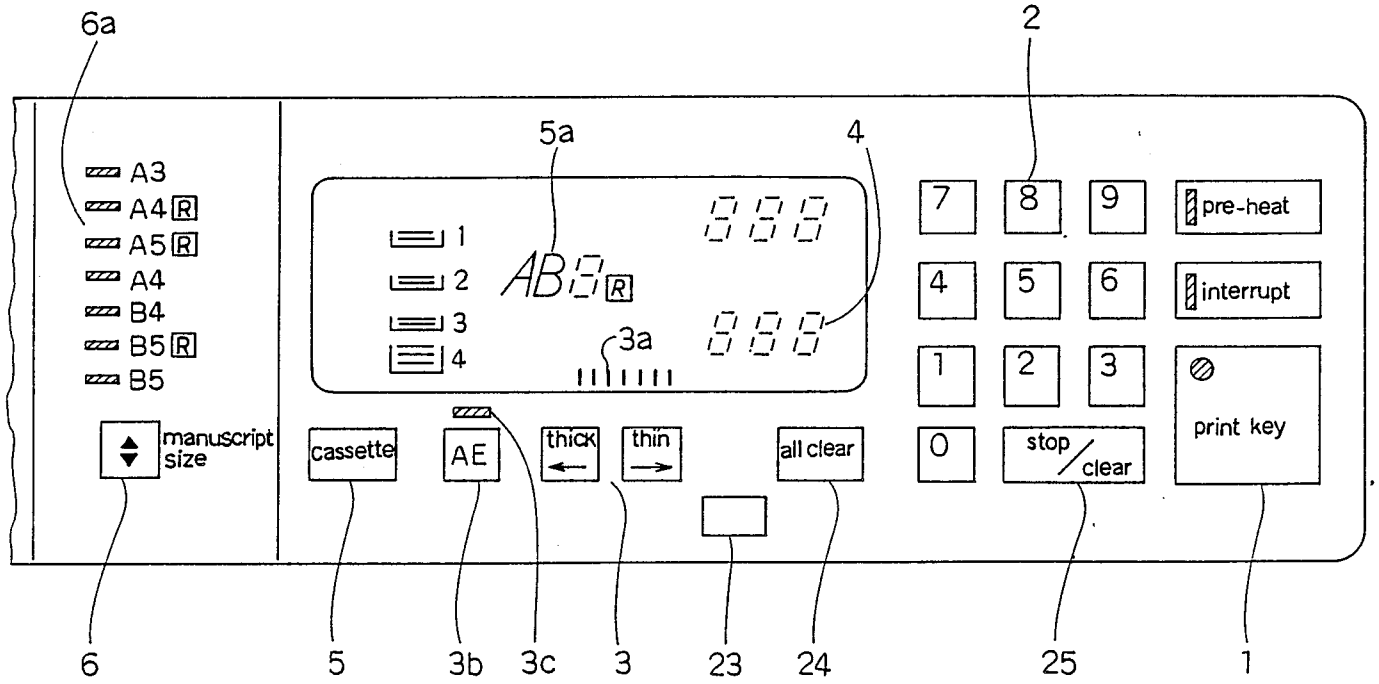

FIGS. 1 (*a*), (*b*) show a plane view of a console of an embodiment of the present invention.

In the FIG. 1, a console 100 is attached on an upper face of the copying machine of the present invention. The console 100 has function set means 200 for setting various kinds of image forming functions and function displaying means 300 for displaying the state set by the setting means 200 as belowmentioned.

That is, a print key 1 is a key for starting the copying operation. TEN keys 2 provide for setting the number of times of performing a copying operation and so on. A density control key 3 is a key for controlling the copy toner density. A lamp 3*a* is a lamp for displaying the copy toner density. A key 3*b* is a key for instructing automatic control of the density and a lamp 3*c* is a lamp for indicating a mode of the automatic control of the density. An LED indicator 4 is an indicator for indicating the pre-set number of times for copying. A sheet size select key 5 is a key for selecting size of the copy sheet, for example, B5, A4 and so on. A LED indicator 5*a* is an indicator for indicating the selected size of the copy sheet. A manuscript size set key 6 is a key for setting a size of a manuscript. A lamp 6*a* is a lamp for indicating the set manuscript size. A magnifying power instructing key 7 is a key for instructing the magnifying power for copying. A LED indicator 7*a* is an indicator for displaying the instructed magnifying power. A partition copy key 8 is a key for instructing a partition copying wherein a manuscript is divided and copied at each divided zone. For example, a book which is set open on a contact plate of the copying machine is copied at each page. A lamp 8*a* is a lamp for indicating the kind of the partition copying. A both side copy key 9 is a means for instructing both side copying. A lamp 9*a* is a lamp for indicating the kind of manuscript for both side copying. A page write copy key 10 is a key for instructing a page writing. A lamp 10*a* is a lamp for indicating page writing. A cover sheet copy key 11 is a key for instructing cover copying. A lamp 11*a* is a lamp for indicating the kind of cover copying. A key 12 is a key for instructing a group mode (stack mode), a sort mode or a non-sort mode. A lamp 13 indicates the selection of the group mode, a lamp 14 indicates the selection of the sort mode and a lamp 15 indicates the non-sort mode, that is, indicates that the group mode and sort mode are not selected.

A program output means 17, 18, 19 instructs that the copying machine be placed in a "program mode" and the various kinds of image forming functions memorized in a below-mentioned second memory 26, 27, 28 are written into a first memory 29. A lamp 20, 21, 22 is a lamp for indicating that the program output means 17, 18, 19 is ON.

A program input means 16 instructs that under the program mode, the various kinds of image forming functions memorized in the first memory 29 are written into the second memory 26, 27, 28.

An initializing means 23 instructs that the contents of the first memory 29 becomes a standard state, thereby maintaining the program mode.

An all clear key 24 cancels all modes including the program mode. A clear key 25 makes the pre-set number zero.

Figure 2:
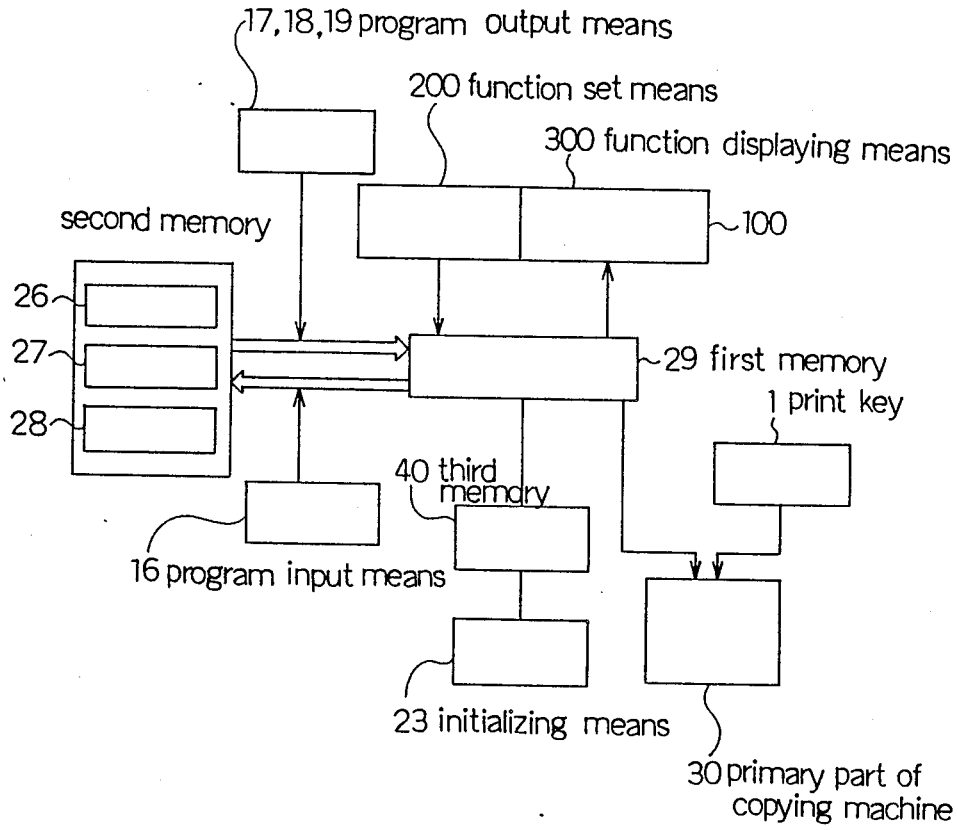
FIG. 2 shows a block diagram of the embodiment of the present invention.

FIG. 2 shows a block diagram of the embodiment of the present invention.

In FIG. 2, the function set corresponds to 200 means the above-mentioned density control key 3, the sheet size select key 5, the manuscript size set key 6, the magnifying power instructing key 7, the partition copy key 8 and so on. The function displaying means 300 corresponds to the LED indicator 5*a* indicating the selected sheet size, the lamp 6*a* indicating the set manuscript size, the LED indicator 7*a* indicating the magnifying power, the lamp 8*a* indicating the kinds of partition copy and so on.

Second memories 26, 27, 28 memorize the suitably set various kinds of functions, so called a "program". In the embodiment, three second memories 26, 27, 28 are provided, and thereby three kinds of programs can be memorized.

A first memory 29 memorizes the various kinds of functions set by the function set means 200. The function displaying means 300 displays the functions memorized in the first memory 29.

A primary part 30 of the image forming apparatus forms images according to the image forming functions memorized in the first memory 29, by the print key 1.

The initializing means 23 initializes the first memory 29 by writing the below-mentioned standard state information memorized in a third memory 40, into the first memory 29.

The above-mentioned embodiments are usually realized by utilizing a microcomputer.

Figure 3:
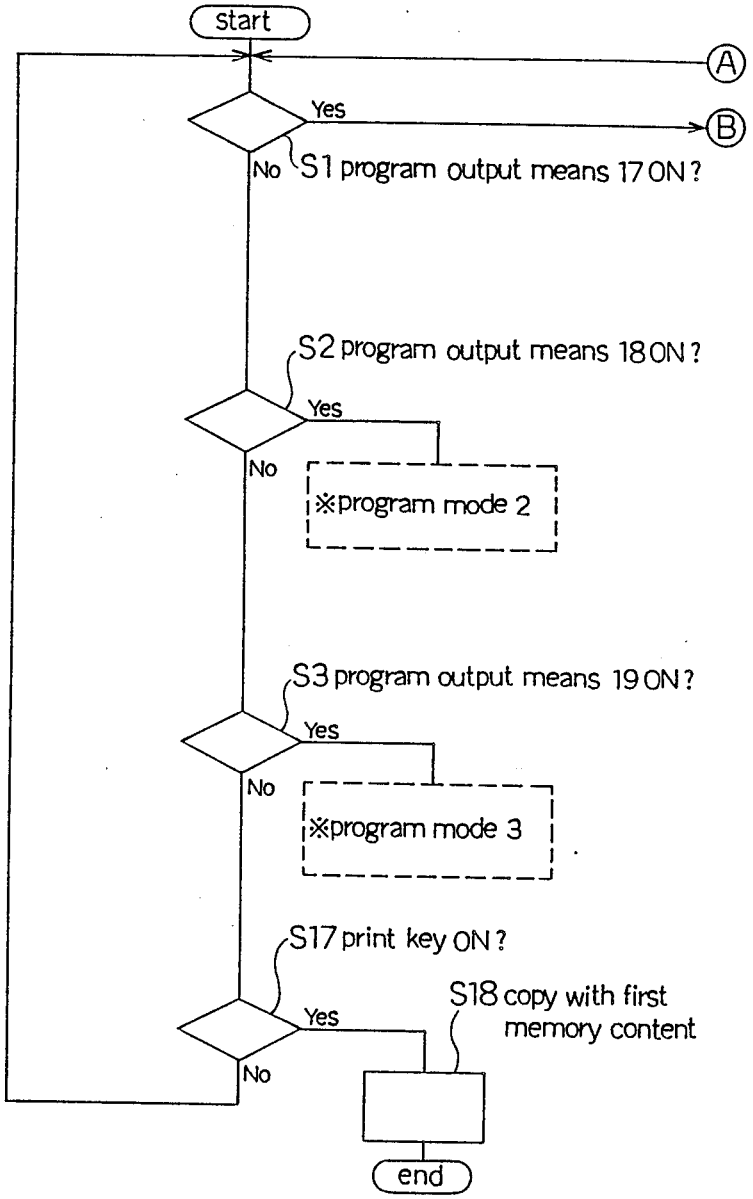
FIGS. 3 (*a*), (*b*) show a flowchart of operation of the embodiment of the present invention.
Figure 3:
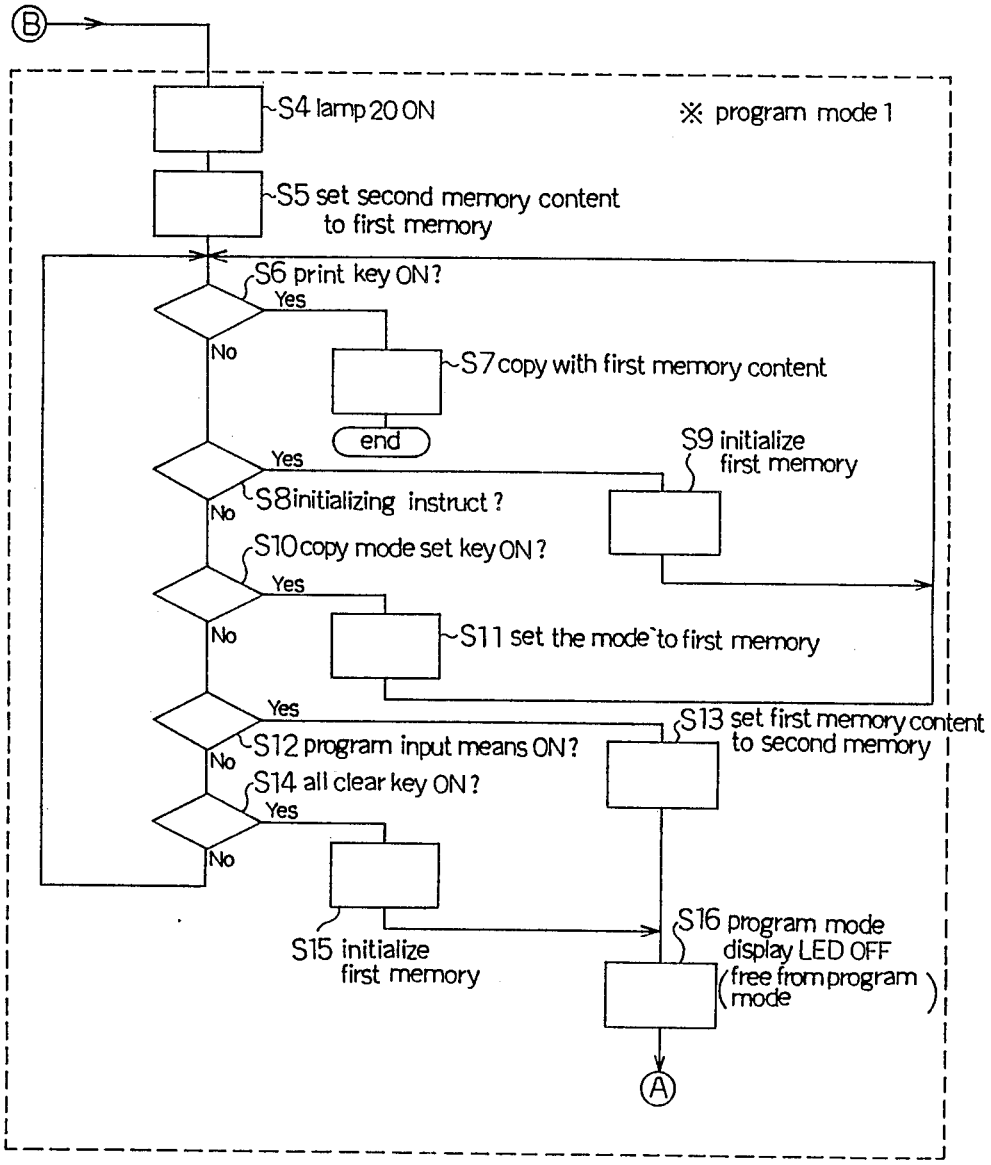

The operation of the above-mentioned embodiments is described as follows on the basis of the flowchart of FIGS. 3(*a*), (*b*).

The operator Switches on the program output means 17 (step S1). Then the primary part of the copying machine enters the program mode. The lamp 20 corresponding to the operated program output means 17, goes ON (step S4). And the various kinds of image forming functions memorized in the second memory 26 are written into the first memory 29 (step S5). Then when the print key 1 is ON, the primary part of the copying machine 30 copies according to the contents of the first memory 29 (step S6, S7).

When the print key 1 is not pushed and the initializing means 23 is pushed, the contents of the first memory 29 are initialized to standard state by the third memory 40 ( step S6, S8, S9). The standard state is where, for example, the preset number is 1, the density control is the automatic density control mode, the sheet selection is for the lowest cassette, the manuscript size setting is canceled, all modes of the partition copy, the both side copy, the page writing, the cover copy etc. are canceled and the sorter selection is in a non-sort mode. The standard state information is memorized in the third memory 40.

Under such condition, the operator easily sets his desired functions in the first memory 29, utilizing the standard state by the function set means 200( step S10, S11). Therefore when many new functions are rewritten or when most new functions are identical to the standard state, the operator can easily set the new functions.

Then the operator writes the contents of the first memory 29 to the second memory 26 by pushing the program input means 16( step S12, S13). Thus the operator easily rewrites the contents of the program in the second memory 26, 27, 28. Then the display lamp 20 of the program output means 17 goes OFF( step S16).

Then the operator calls up the contents of the second memory 26 and writes it to the first memory 29 and then executes copying according to the new program by pushing the print key 1( step S1, S4, S5, S6, S7).

When the operator pushes the all clear key 24, the contents of the first memory 29 is initialized and the program mode is canceled( step S15, S16). Meanwhile, the contents of the second memory 26 are not rewritten.

When the program output means 18, 19 is ON, the same operation as above-mentioned is executed (step S2, S3). When the program mode is not used and besides the print key 1 is pushed, the copy operation is executed on the basis of the contents of the first memory 29 (step s17, s18).

Meanwhile the all clear key 24 can also serve as the initializing means 23 in another embodiment. The all clear function and the initializing function are properly used by the operator's selecting the number of times of pushing the all clear key 24.

Further the clear key 25 can also serve as the initializing means 23 in another embodiment. The clear function and the initializing function are properly used by the operator's selecting the number of times of pushing the clear key 25.

As above-mentioned, in the image forming apparatus of the present invention, for rewriting the program, the operator can easily set desired image forming functions on the basis of a standard state by initializing, when many functions are rewritten or when functions similar to the standard state are set.

While the preferred form of the present invention has been described, it is to be understood that modifications will be apparent to those skilled in the art without departing from the spirit of the invention.

I claim:

1. An image forming apparatus comprising;

function set means for setting various kinds of image forming functions, first memory means for memorizing said various kinds of image forming functions set by said function set means, function displaying means for displaying said various kinds of image forming functions memorized in said first memory means, second memory means for memorizing preset various kinds of image forming functions, program output means for placing said image forming apparatus in a program mode and for causing said various kinds of image forming functions set in said second memory means to be written to said first memory means, program input means for causing said various kinds of image forming functions set in said first memory means to be written to said second memory means when said image forming apparatus is placed in said program mode, a print key for starting image forming by said image forming apparatus, a third memory means for memorizing standard state information comprising predetermined image forming functions, initializing means for initializing said first memory means when said image forming apparatus is placed in said program mode by causing the contents of said third memory means to be written to said first memory means, and primary part means of said image forming apparatus for copying on the basis of said various kinds of image forming functions set in said first memory means by a signal from said print key.

* * * * *